US006541913B1

(12) United States Patent
Mori et al.

(10) Patent No.: US 6,541,913 B1
(45) Date of Patent: Apr. 1, 2003

(54) FLAT DISPLAY APPARATUS

(75) Inventors: Hiroshi Mori, Kanagawa (JP); Hidehiro Kawaguchi, Kanagawa (JP)

(73) Assignee: Sony Corporation (JP)

( * ) Notice: Subject to any disclaimer, the term of this patent is extended or adjusted under 35 U.S.C. 154(b) by 212 days.

(21) Appl. No.: 09/605,872

(22) Filed: Jun. 29, 2000

(30) Foreign Application Priority Data

Jul. 2, 1999 (JP) ..... 11-189438

(51) Int. Cl.[7] ..... H01J 17/49
(52) U.S. Cl. ..... 313/582; 313/586
(58) Field of Search ..... 313/582, 584, 313/586, 587

(56) References Cited

U.S. PATENT DOCUMENTS 5,661,500 A * 8/1997 Shinoda et al. ..... 345/60
5,674,553 A * 10/1997 Shinoda et al. ..... 427/68

FOREIGN PATENT DOCUMENTS

| | | |
|---|---|---|
| EP | 0580868 | 2/1994 |
| EP | 0779643 | 6/1997 |
| EP | 0923106 | 6/1999 |
| EP | 0996138 | 4/2000 |
| WO | 9909578 | 2/1999 |

* cited by examiner

*Primary Examiner*—Robert H. Kim
*Assistant Examiner*—Jurie Yun
(74) *Attorney, Agent, or Firm*—Rader, Fishman & Grauer PLLC; Ronald P. Kananen, Esq.

(57) ABSTRACT

In a flat display device, display can be carried out with high definition and high density, and furthermore, driving power, that is, consumed power can be reduced. First and second substrates 1 and 2 are provided opposite to each other, the first substrate 1 is provided with a discharge maintaining electrode group 5 having a plurality of discharge maintaining electrodes 3 and 4 arranged thereon, and the second substrate 2 is provided with an address electrode group 9 having a plurality of address electrodes 8 arranged thereon. The discharge display is carried out through negative glow discharge and cathode glow discharge.

8 Claims, 8 Drawing Sheets

FLAT DISPLAY APPARATUS

BACKGROUND OF THE INVENTION

1. Field of the Invention

The present invention relates to a flat display apparatus using AC plasma discharge display.

2. Description of the Related Art

For example, Japanese Patent Laid-Open No. Hei 7-220641 has disclosed a flat display apparatus utilizing plasma discharge.

An example of a conventional flat display apparatus, for instance, as shown in FIG. 8 of a schematic perspective view with a partially cut away, and FIG. 9, of a schematic exploded perspective view, is composed of a flat vessel in which first and second substrates 101 and 102 for example, formed of a glass substrate are opposed to each other with a predetermined space held therebetween and the surroundings are sealed with airtightness.

A discharge maintaining electrode group 105 is provided on the internal surface of the first substrate 101, in which plural pairs of discharge maintaining electrodes 103 and 104 are formed of transparent conductive layers making a pair, for example, and are arranged in parallel.

The discharge maintaining electrodes 103 and 104 formed of the transparent conductive layers have high resistivities. Therefore, so-called bus electrodes 103*b* and 104*b* formed of metal layers having high conductivities are formed along the side edges opposed to the opposed sides of the pair of electrodes 103 and 104.

Partition walls 106 extended in a direction orthogonal to a direction of extension of the discharge maintaining electrodes 103 and 104 are provided with a predetermined space in parallel and a stripe-shaped address electrode 107 is formed between the partition walls 106 on the internal surface of the second substrate 102. Similarly, phosphors R. G and B having colors for emitting red, green and blue colors, for example, are coated by excitation through vacuum ultraviolet rays generated by plasma discharge between the partition walls 106.

A predetermined discharge starting voltage is applied between a selected address electrode 107 and one of the pair of discharge maintaining electrodes, for example, the electrode 103 so that the discharge is started in a portion where they cross. A predetermined AC voltage is applied between the electrode 103 and the discharge maintaining electrode 104 making a pair therewith so that the discharge in this portion is maintained. Through the vacuum ultraviolet rays generated by the discharge, light is emitted from the phosphor positioned in the cross portion and light emission display to be intended is carried out.

In such a conventional flat display device using general plasma discharge display, it is presupposed that both the discharge start and the discharge maintenance are carried out though negative glow discharge. For this reason, a space between the address electrode and the discharge maintaining electrode and a space between the pair of discharge maintaining electrodes are selected to be 100 $\mu$ms or more, for example, 130 $\mu$ms to 300 $\mu$ms which is a space between the electrodes for the generation of the negative glow discharge.

SUMMARY OF THE INVENTION

In the flat display apparatus of this type, recently, an enhancement in the density and definition of pixels has been required increasingly.

In order to obtain such an increase in the density and definition, it has been required that the pitch of the pair of discharge maintaining electrodes should be reduced.

In the conventional flat display apparatus using the negative glow discharge, however, if the space between the pair of discharge maintaining electrodes for carrying out discharge is reduced to 100 $\mu$m or less, the discharge is not fully carried out so that the efficiency of generation of the ultraviolet rays is decreased. Consequently, the excitation of phosphors becomes insufficient so that a brightness is reduced. Therefore, the space between the pair of discharge electrodes is selected to be at least 100 $\mu$ms or more in the conventional general flat display apparatus. Correspondingly, the pitch between the pair of discharge maintaining electrodes is at least two hundreds and several tens $\mu$ms. For this reason, there is a problem that an increase in the density and definition cannot be fully obtained.

The present invention has an object to enhance high definition and high density display in a flat display apparatus, and furthermore, to reduce driving power, that is, consumed power.

The present invention provides a flat display apparatus in which first and second substrates are positioned opposite to each other, the first substrate is provided with a discharge maintaining electrode group having a plurality of discharge maintaining electrodes arranged thereon and the second substrate is provided with an address electrode group having a plurality of address electrodes arranged thereon. The discharge display is carried out in a discharging manner through ordinary negative glow discharge and mainly through cathode glow discharge.

In the present invention, thus, the negative flow discharge and the cathode glow discharge are combined for the discharging manner. Consequently, respective characteristics can be utilized.

More specifically, the pitch of the pair of discharge maintaining electrodes in the discharge maintaining electrode group can be reduced, that is, to be less than 50 $\mu$ms, preferably 20 $\mu$ms or less which is much smaller than 100 $\mu$ms. Thus, it is possible to fully increase the density and definition of pixels.

Referring to the discharge maintaining electrode group 105 having such a structure that the conventional discharge maintenance is carried out by the negative glow discharge, FIG. 10A is a schematic plan view showing a part thereof (illustrating only two pairs of discharge maintaining electrodes 103 and 104) and FIG. 10B is a sectional view taken along the line B—B shown in FIG. 10A, in which the discharge maintaining electrodes 103 and 104 formed of a band-shaped transparent conductive layer are arranged with a space D of 100 $\mu$ms or more, for example, approximately 130 to 300 $\mu$ms as described above. A space Dc between an adjacent pair of discharge maintaining electrodes should be minimum. Therefore, even if a width W of each of the discharge maintaining electrodes 103 and 104 is selected to be small, for example, approximately 30 to 40 $\mu$ms, a pitch P of each set of discharge maintaining electrodes should be set to at least two hundreds and several tens $\mu$ms, thereby obstructing an increase in the density and definition of displayed pixels.

On the other hand, as described above, in the case that the discharge maintenance is carried out by the cathode glow discharge, the space between the pair of discharge maintaining electrodes can be reduced to 20 $\mu$ms or less. Consequently, the pitch of each pair of discharge maintaining electrodes can fully be reduced.

According to the present invention, moreover, the driving power can be considerably reduced by using the cathode glow discharge as compared with the case of the negative glow discharge. In particular, great power saving effects can be obtained by the driving power in large screen display.

Alternatively, brighter display can be obtained with the same consumed power.

BRIEF DESCRIPTION OF THE DRAWINGS

FIG. 10, including

DESCRIPTION OF THE PREFERRED EMBODIMENTS

An example of a flat display apparatus according to an embodiment of the present invention will be described below with reference to the drawings.

Figure 1:
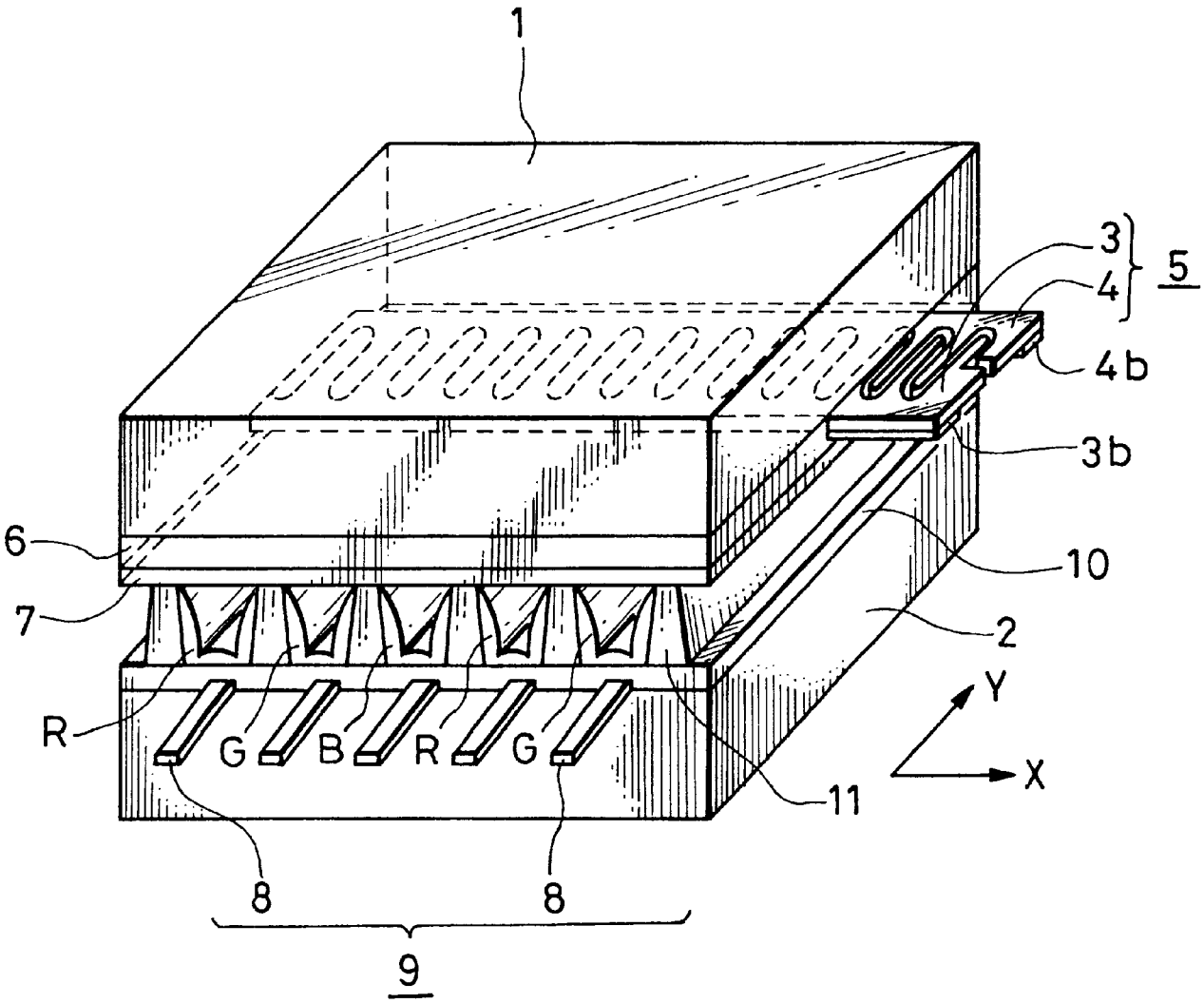
FIG. 1 is a schematic perspective view showing the main part of an example of a flat display apparatus according to the present invention.
Figure 2:
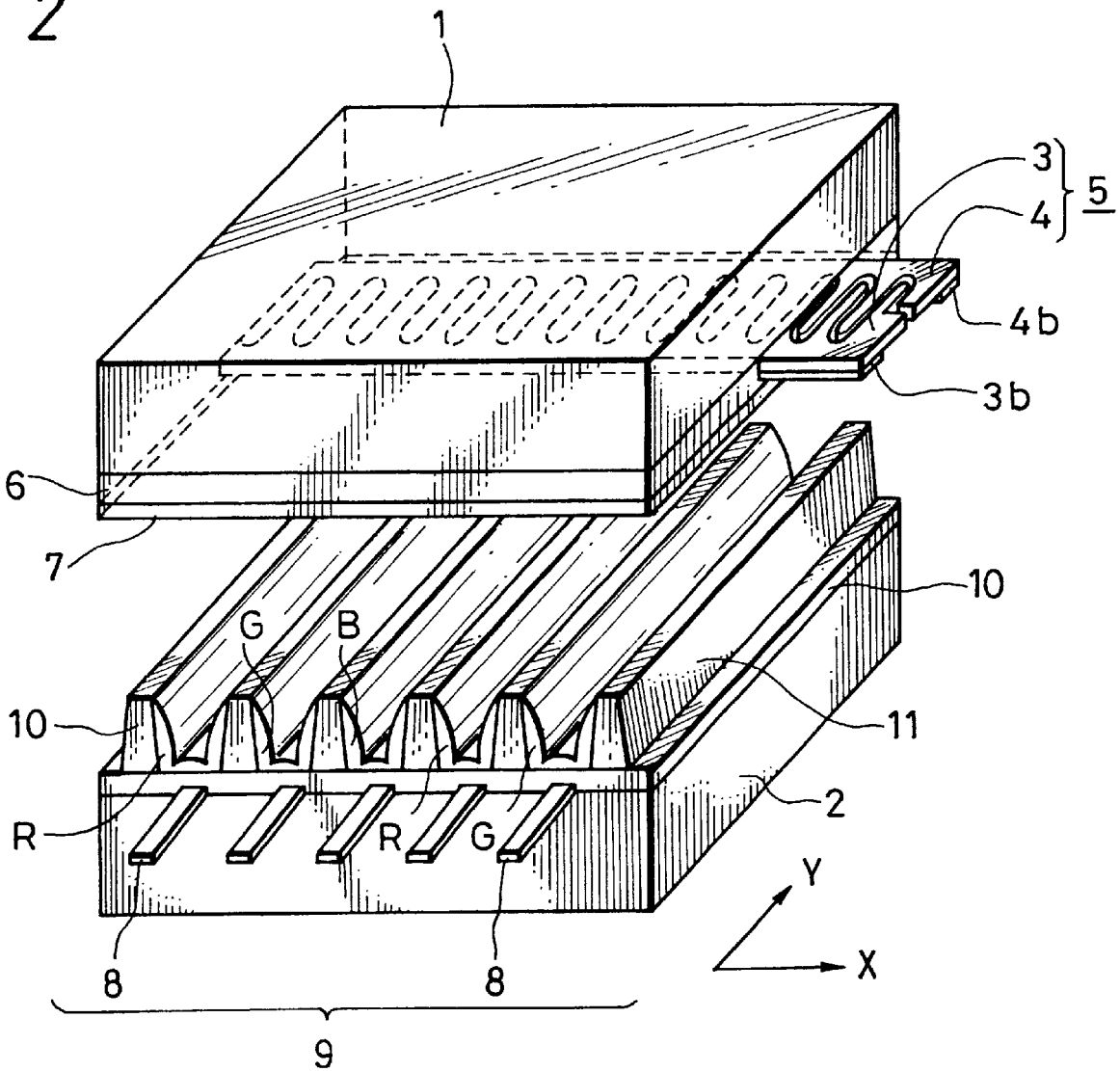
FIG. 2 is an exploded perspective view showing the main part of the example of the flat display apparatus according to the present invention.

FIG. 1 is a schematic perspective view, a part of which is taken away, and FIG. 2 is a schematic exploded perspective view. However, the present invention is not restricted to this example.

In the flat display apparatus according to the present invention, first and second substrates 1 and 2 formed of a glass plate, for example, are opposed to each other with a predetermined space held therebetween and the surroundings are sealed with airtightness through frit seal, for example, thereby constituting a flat vessel, which is not shown.

In this example, light emission display is observed on the first substrate 1 side. In this case, at least the first substrate 1 is formed by a transparent glass substrate through which display light is transmitted.

The internal surface of the first substrate 1 is provided with a discharge maintaining electrode group 5 in which plural pairs of discharge maintaining electrodes 3 and 4 formed of a transparent conductive layer, for example, ITO (indium tin oxide) are arranged in parallel with each other like a stripe, for example, with a main extending direction thereof extended in a first direction along the plate surface of the substrate 1, for example, an X direction in the drawing (while only one set of discharge maintaining electrodes 3 and 4 are shown in FIGS. 1 and 2, plural sets of discharge maintaining electrodes 3 and 4 are arranged in parallel).

The space between opposed electrodes making a pair for the discharge maintenance of both discharge maintaining electrodes 3 and 4 is selected to be less than 50 $\mu$ms, preferably 20 $\mu$ms or less, for example, 10 $\mu$ms at which the cathode glow discharge is mainly generated and the negative glow discharge is not basically generated.

In the case in which the discharge maintaining electrodes 3 and 4 are to be formed of a transparent conductive layer, bus electrodes 3*b* and 4*b* made of a metal conductive layer such as Al, Ag, Cu, Ni or the like having an excellent conductive property for compensating for the conductive properties of the discharge maintaining electrodes 3 and 4 are formed along side edges on the opposite side to the mutual opposed sides of the discharge maintaining electrodes 3 and 4, that is, in the main extending direction of each of the discharge maintaining electrodes 3 and 4 because the conductive property is generally poor.

A dielectric layer 6 made of $SiO_2$ or the like is formed over the discharge maintaining electrodes 3 and 4, and furthermore, a surface layer 7 made of MgO, for example, which has a small work function and serves to protect the electrodes is formed.

Moreover, the second substrate 2 is provided with an address electrode group 9 in which address electrodes 8 extended in a second direction Y crossing, for example, orthogonal to the first direction X across the discharge maintaining electrodes 3 and 4 are provided in parallel with a predetermined space.

A dielectric layer 10 formed of $SiO_2$ or the like is provided over the address electrodes 8.

An insulating partition wall 11 extended in the extending direction of the address electrodes 8 is provided between the address electrodes 8. The partition wall 11 has the function as a spacer for holding a space to have a predetermined thickness between the first and second substrates 1 and 2 and the function of dividing a discharge space in the X direction.

The height of the partition wall 11 is selected such that the space between the address electrode 8 and the discharge maintaining electrode 3 or 4 which is opposed to the address electrode 8 and serves to carry out discharge start, that is, the rising of the discharge is set to a space in which the negative glow discharge is generated in place of the cathode glow discharge, that is, a space of 100 $\mu$ms or more, for example, 150 $\mu$ms.

Moreover, phosphors R, G and B for emitting light having red, green and blue colors in the Y direction by excitation through vacuum ultraviolet rays, for example, are coated between the partition walls 11 such that they are arranged in predetermined order in the X direction.

An airtight space formed by the first and second substrates 1 and 2 is exhausted and is filled with a predetermined discharge gas, for example, one or more of rare gases such as He, Ne, Ar, Xe and Kr, for example, a so-called Penning gas which is an optimum mixed gas of Ne and Xe. The gas is filled at such a pressure as to stably maintain discharge having a high luminance and a high efficiency in relation to the space between the address electrode 8 and the discharge maintaining electrode 3 or 4. For example, the Penning gas of Ne (96%) and Xe (4%) is filled at a pressure of 100 kPa.

Figure 3:
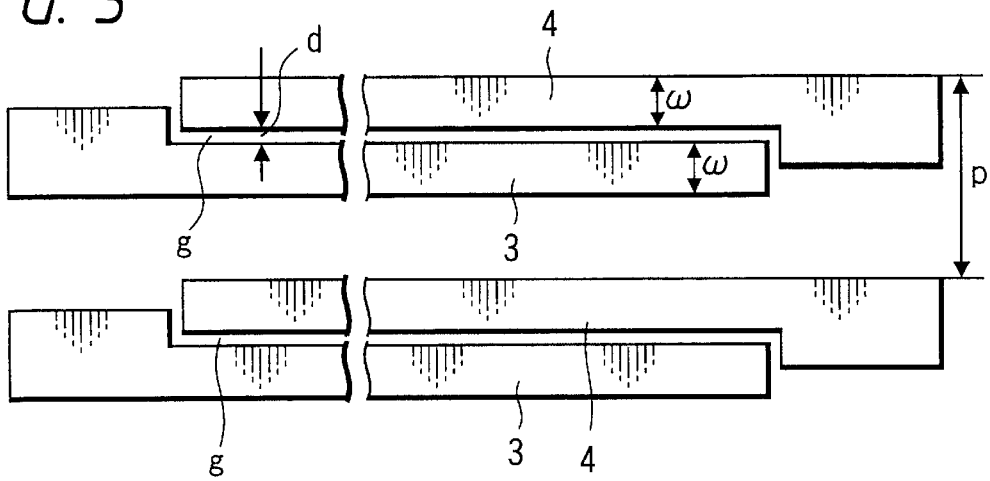
FIG. 3 is a plan view showing a part of a discharge maintaining electrode of the example of the flat display apparatus according to the present invention.
Figure 4:
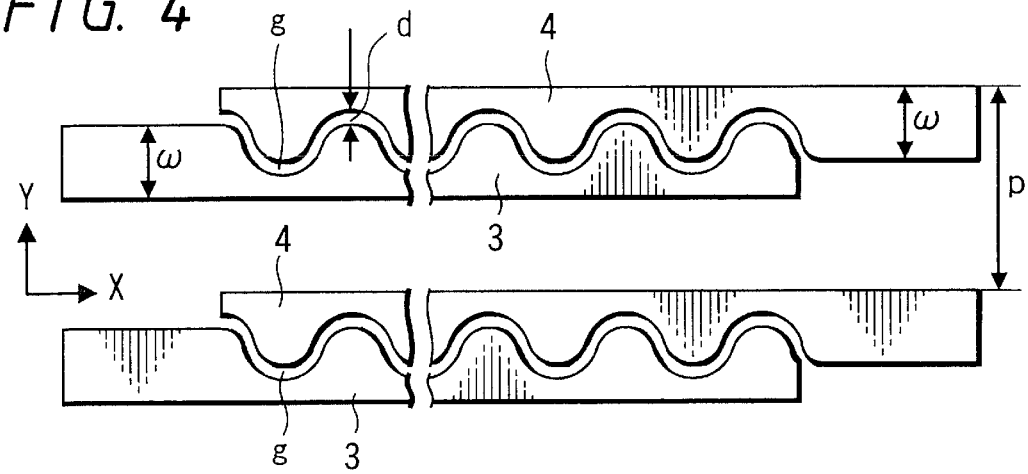
FIG. 4 is a plan view showing a part of the discharge maintaining electrode of another example of the flat display apparatus according to the present invention.
Figure 5:
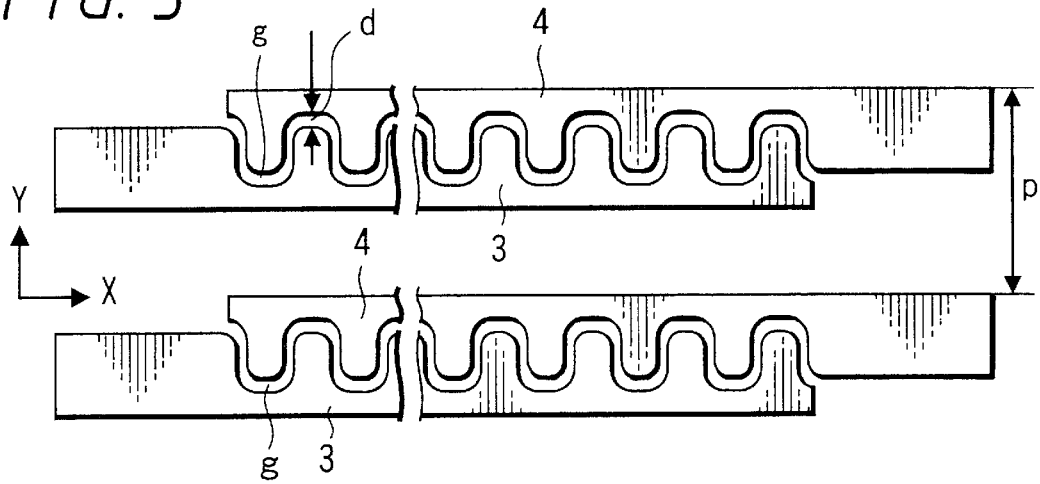
FIG. 5 is a plan view showing a part of the discharge maintaining electrode according to yet another example of the flat display apparatus according to the present invention.

With the pattern of each of the discharge maintaining electrodes 3 and 4, a space d between two sets of discharge maintaining electrodes 3 and 4 making a pair for discharge maintenance is selected to be less than 50 μms, preferably 20 μms or less, for example, 10 μms as typically shown in FIGS. 3 to 5, for example, respectively, and a gap g between the electrodes 3 and 4 has such a rectilinear shape as to be extended in the extending direction X of the electrodes 3 and 4 as shown in FIG. 3 or the gap g is curved or bent as shown in FIGS. 4 and 5.

The gap g is corrugated, for example, in the cross direction Y of the electrodes 3 and 4 with the space d held therebetween in the example shown in FIG. 4, and is formed to have a saw-toothed zigzag pattern in the example shown in FIG. 5.

Also in the flat display device according to the present invention, a predetermined discharge starting voltage is applied between the selected address electrode 8 and one of the pair of discharge maintaining electrodes 3 and 4, for example, the electrode 3, thereby starting the discharge through the negative glow discharge in a portion where they cross, and a predetermined AC voltage is applied between the discharge maintaining electrode 3 and the discharge maintaining electrode 4 making the pair therewith, thereby maintaining the discharge in this portion through the cathode glow discharge and causing the phosphors R, G and B positioned in the crossing portion to emit light through the vacuum ultraviolet rays generated by the discharge. Thus, the light emission display to be intended is carried out.

Figure 6B:
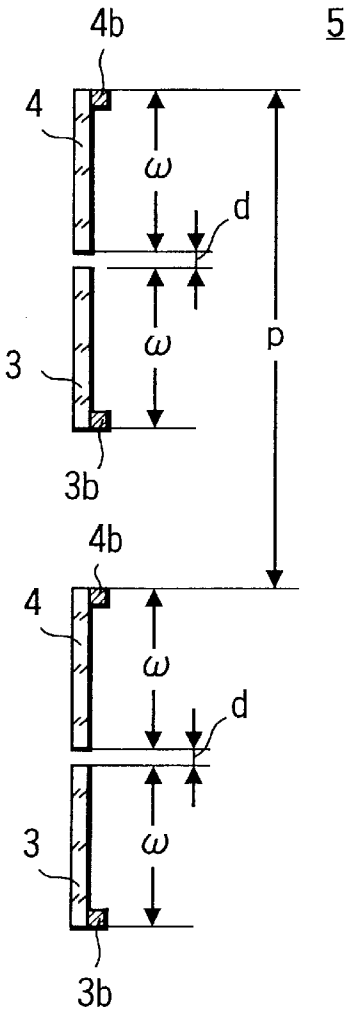
FIGS. 6A and 6B are a plan view showing a part of the discharge maintaining electrode of the example of the flat display apparatus according to the present invention and a schematic sectional view taken along the line B—B.
Figure 6A:
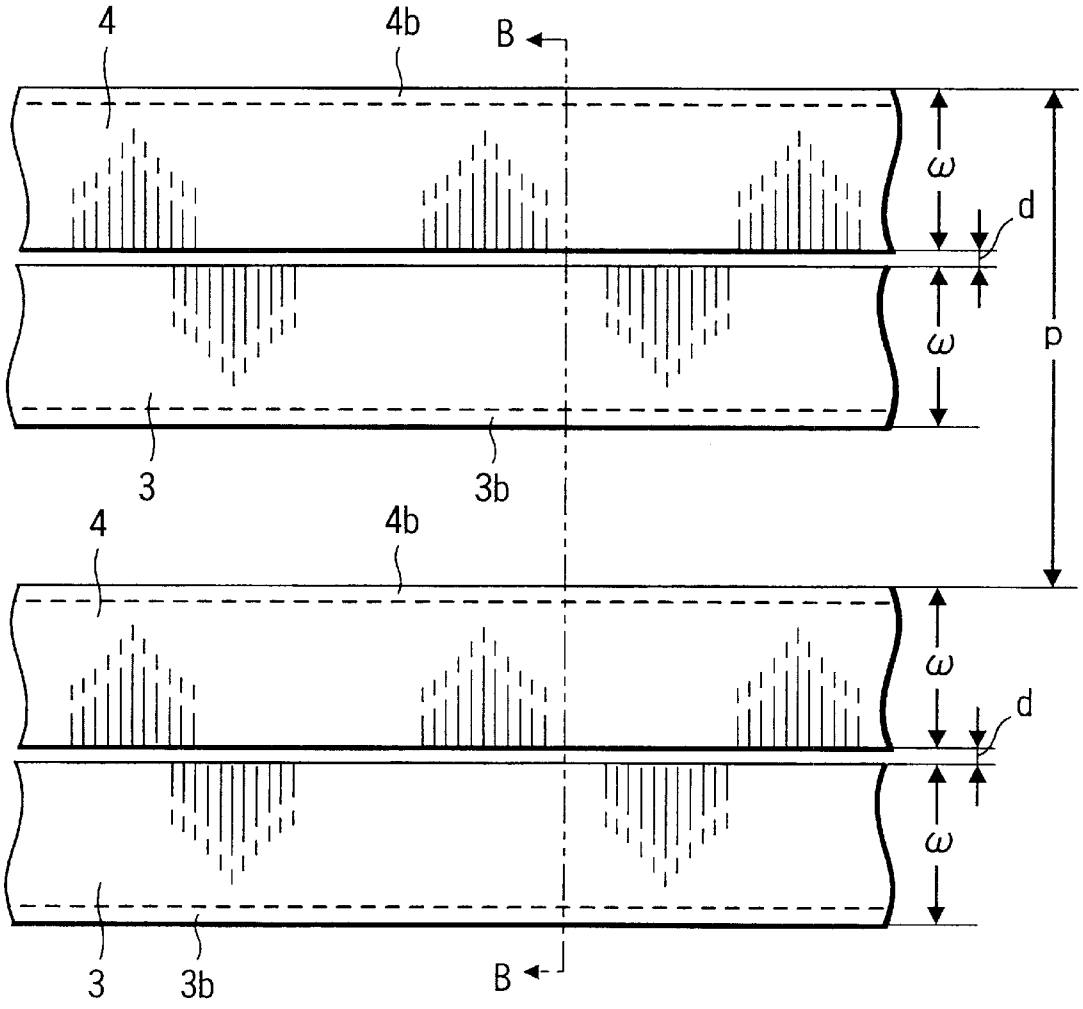
Figure 7:
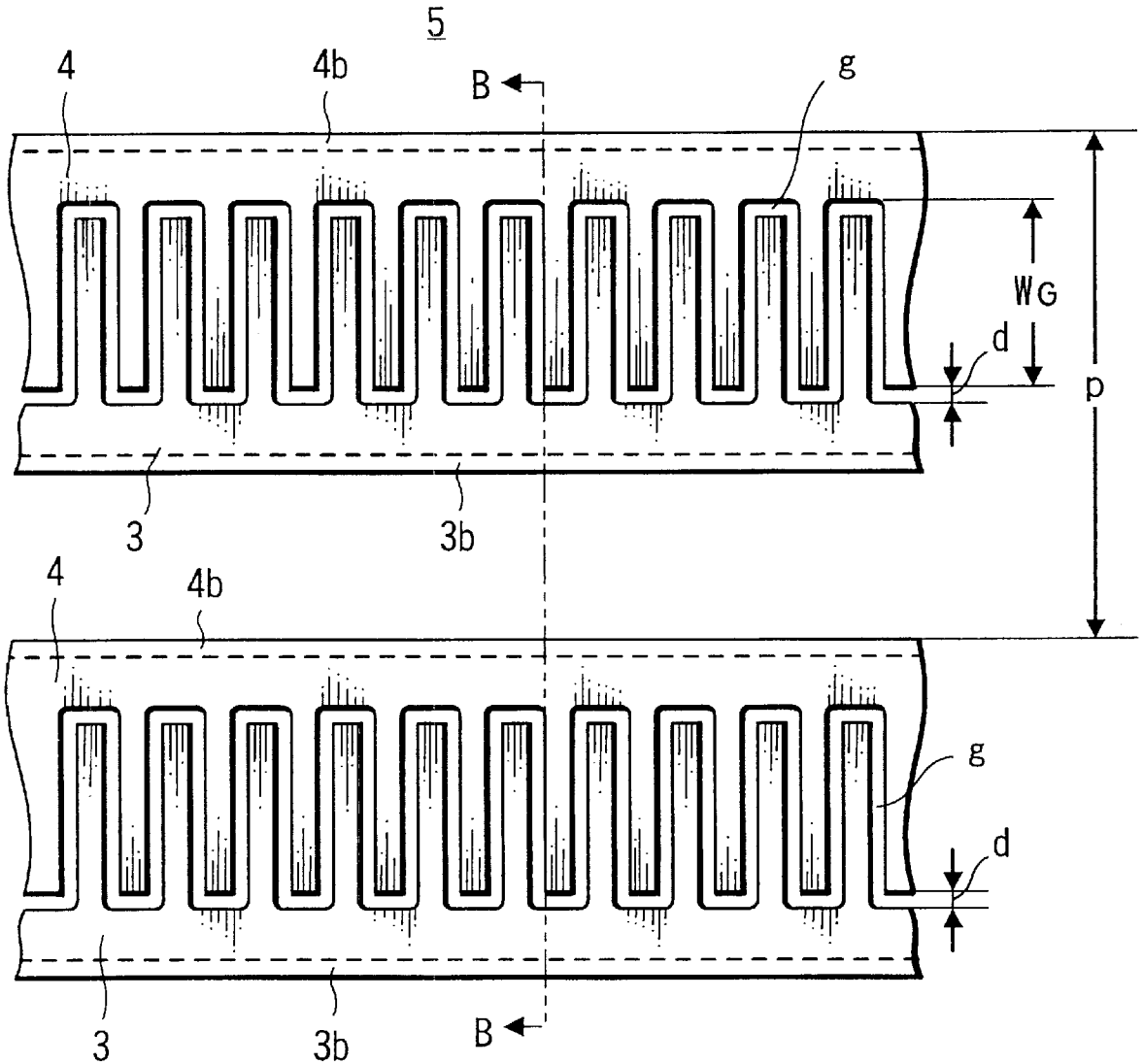
FIG. 7 is a plan view showing a part of the discharge maintaining electrode of a further example of the flat display apparatus according to the present invention.
Figure 8:
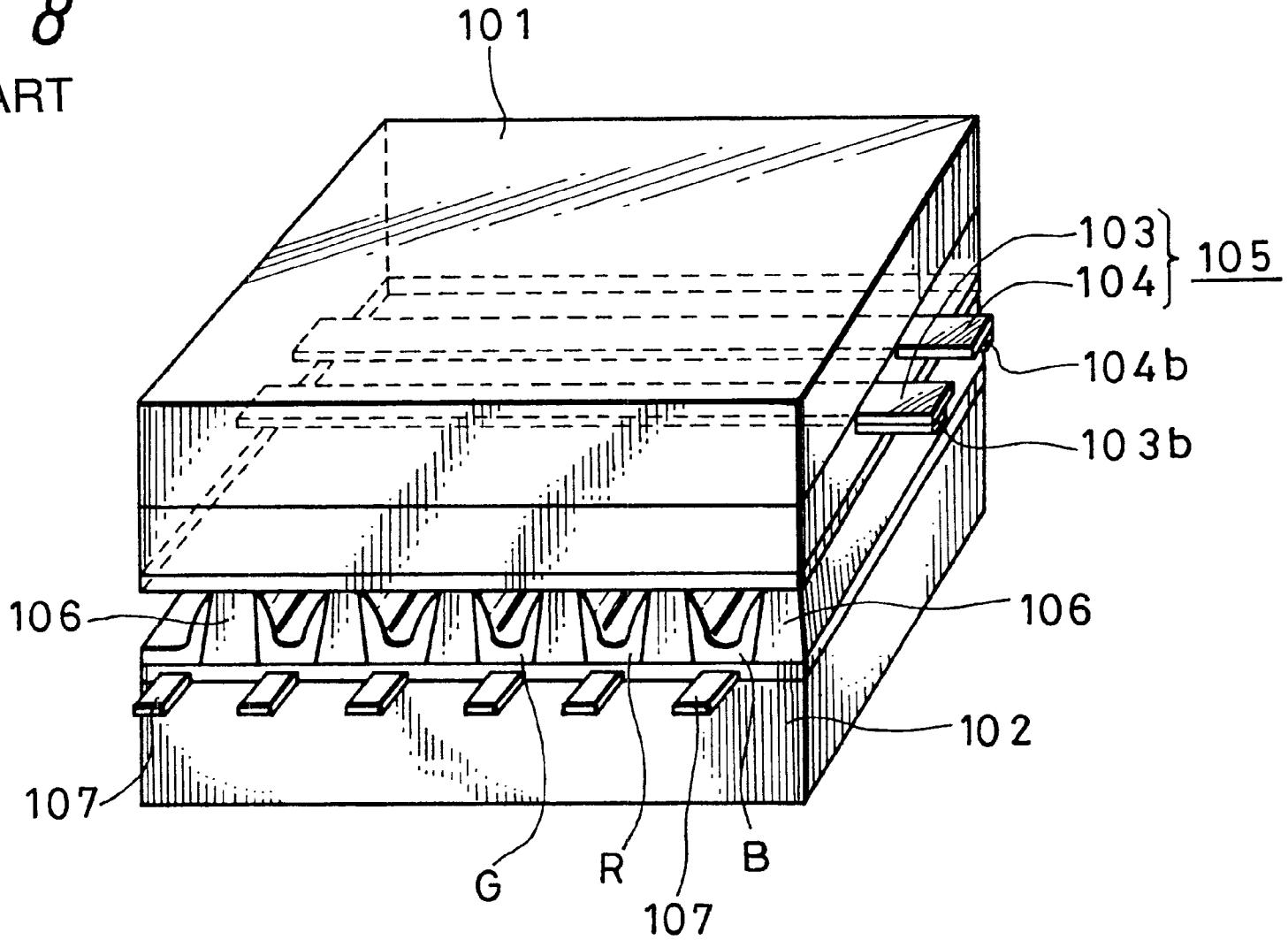
FIG. 8 PRIOR ART
FIG. 8 is a schematic perspective view showing the main part of a conventional apparatus.
Figure 9:
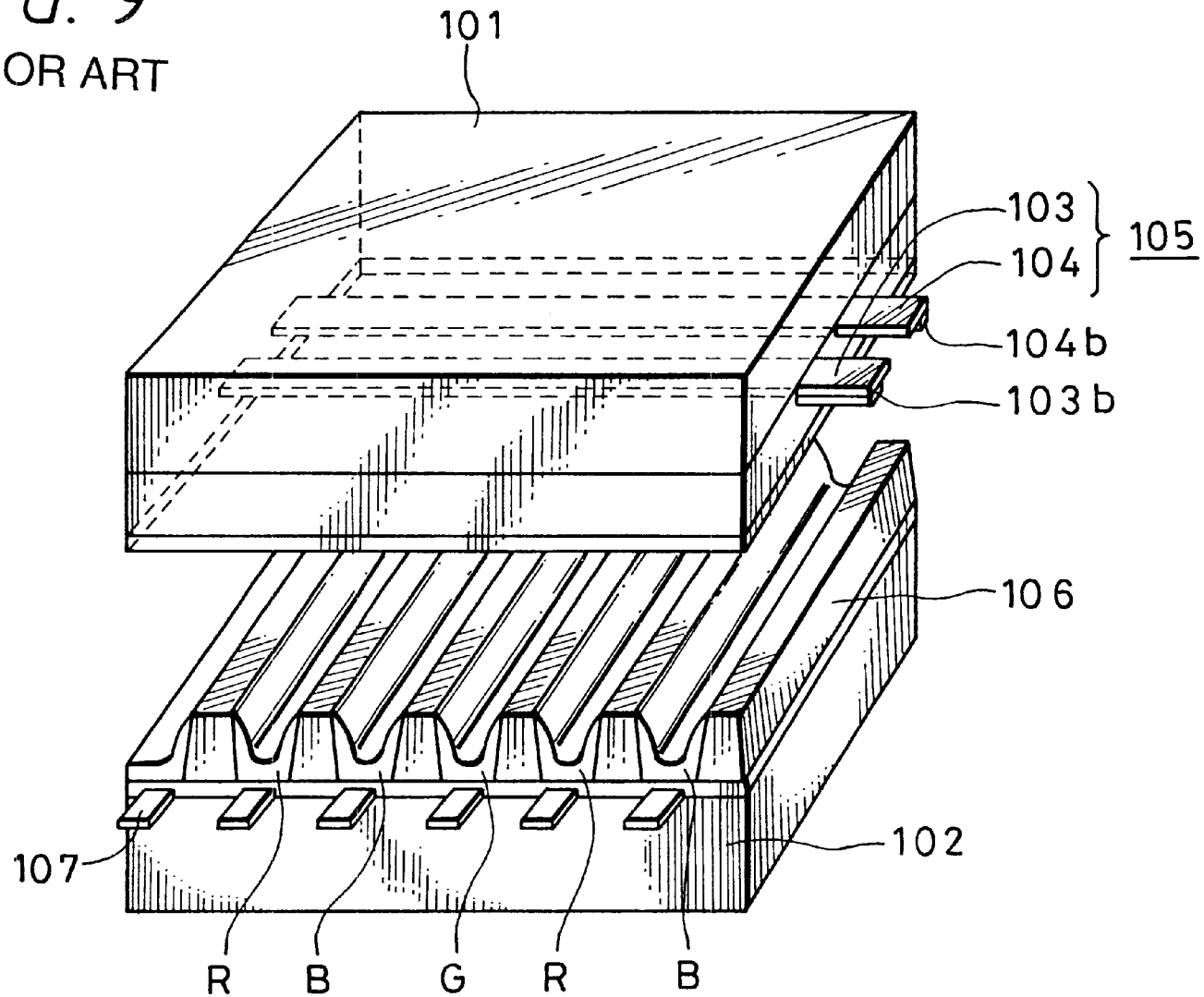
FIG. 9 PRIOR ART
FIG. 9 is an exploded perspective view showing the main part of the conventional apparatus.
Figure 10B:
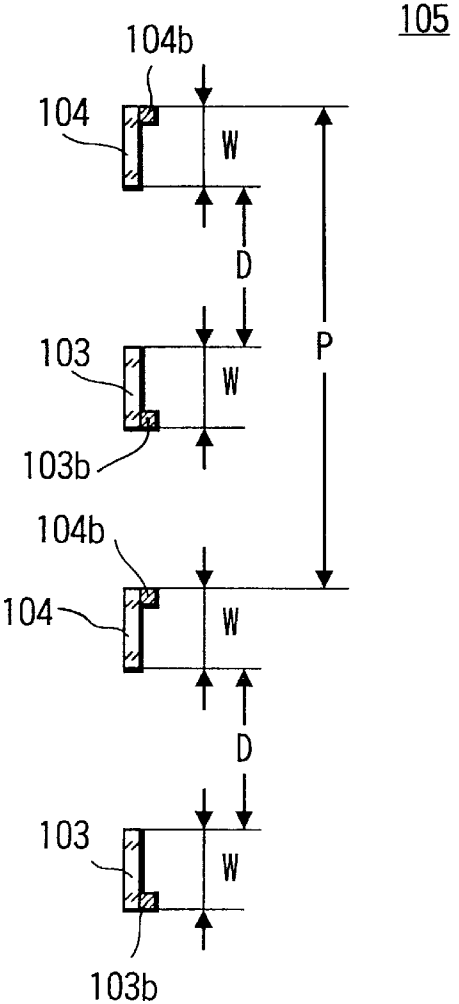
FIG. 10B PRIOR ART
FIGS. 10A and 10B is a plan view showing a part of the discharge maintaining electrode of the conventional apparatus.
Figure 10A:
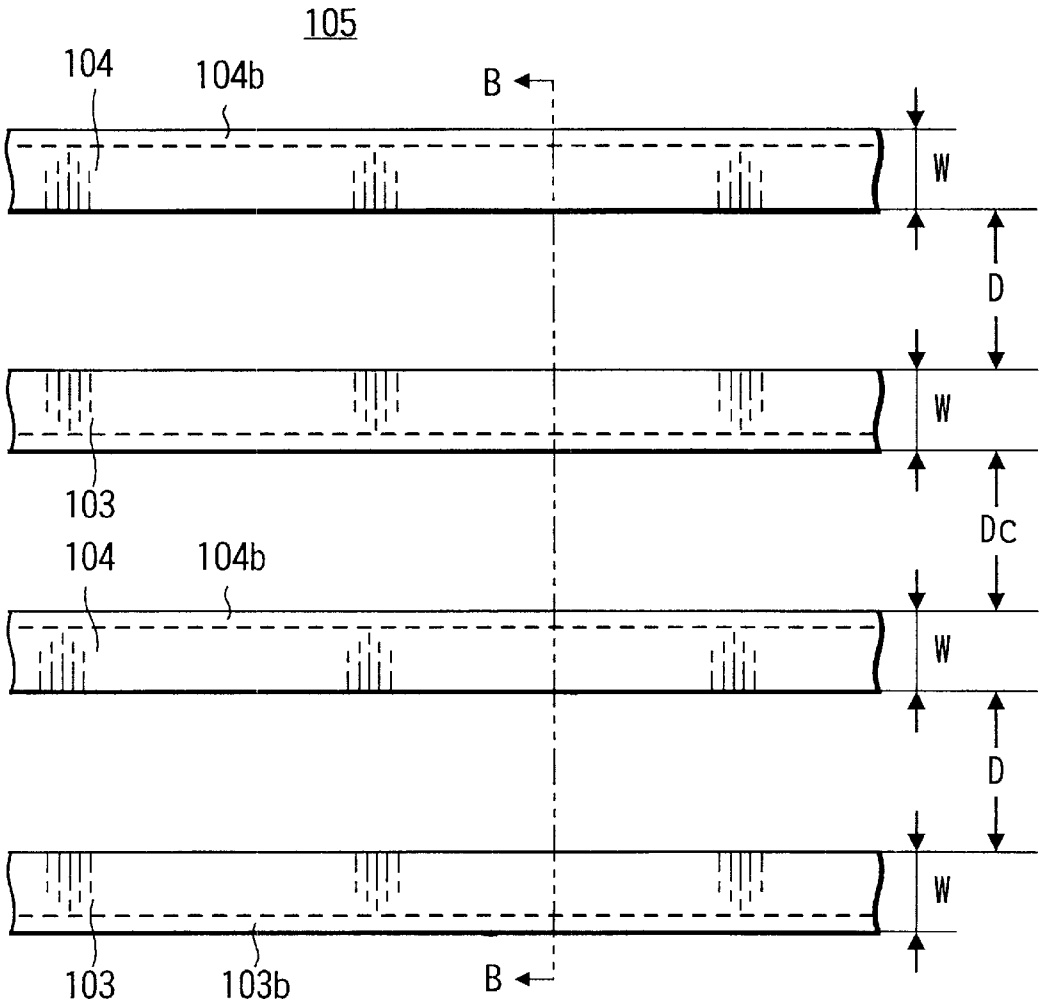
FIG. 10A PRIOR ART

In the above-mentioned device according to the present invention, the space between the discharge maintaining electrodes 3 and 4 is very small as described above. Consequently, the discharge maintenance is mainly carried out through the cathode glow discharge. FIG. 6A is a plan view showing two pairs of adjacent discharge maintaining electrodes 3 and 4. As shown in FIG. 6B which is a sectional view taken along the line B—B in FIG. 6A, when a pitch p between the pair of discharge maintaining electrodes 3 and 4 of the discharge maintaining electrode group 5 is selected to be equal to or less than a conventional pitch P shown in FIG. 10 but is comparatively great, a width ω of the electrodes 3 and 4 can be set to be $\omega >> W$ as compared with a conventional width W. Consequently, the conductive properties of the electrodes 3 and 4 in the longitudinal direction can be enhanced. At this time, the width occupied by the electrodes 3 and 4 can be increased. Therefore, in the case in which the gap g between both discharge maintaining electrodes 3 and 4 is curved or bent as shown in FIGS. 4 and 5, an amplitude $W_G$ can be fully increased as shown in FIG. 7 so that the opposed length of the gap can be increased.

As described above, in the present apparatus, the discharge maintenance is mainly carried out through the cathode glow discharge. Consequently, the driving power can be more reduced than the case of the negative glow discharge. Alternatively, when the driving power is to be set equal to or almost equal to that in the conventional example, it is possible to enhance the efficiency of light emission and a light emitting luminance. For example, when the driving power is to be equal to that in the conventional example, a brightness can be increased by 40% or more.

The discharge starting to be carried out between the address electrode 8 and the discharge maintaining electrode 3 is performed through the negative glow discharge. Therefore, the space between the address electrode 8 and the discharge maintaining electrode 3 is selected to be great, for example, 150 μms. Consequently, the discharge space, the space in a portion where the phosphors R, G and B are arranged, and the area of arrangement of the phosphors R, G and B can fully be increased. Thus, bright display can be obtained.

As described above, moreover, the space between the discharge maintaining electrodes 3 and 4 can be reduced to ¼ or less as compared with the conventional example. Therefore, an arrangement pitch p of each pair of discharge maintaining electrodes can be more reduced than a conventional pitch P. Consequently, the density and definition of the pixel can be enhanced.

The pitch p is selected to be equal to or smaller than the conventional pitch P but to be greater than a minimum pitch. As shown in FIGS. 4, 5 and 7, therefore, the shape of the gap g between the pair of discharge maintaining electrodes 3 and 4 can be set to have a curved or bent pattern. Consequently, the length can be increased so that the amount of generated vacuum ultraviolet rays can be made larger. Thus, the luminance can be more enhanced.

Next, description will be given to an example of a flat display apparatus and a manufacturing method thereof according to the present invention. In the present embodiment, description will be given to an example of the case that the apparatus shown in FIGS. 1 to 3 is obtained. However, the manufacturing method according to the present invention is not restricted to this example.

First of all, an example of the manufacturing method on the first substrate 1 side will be described.

In this case, the first substrate 1 formed of a transparent glass substrate, for example, is prepared, and the discharge maintaining electrodes 3 and 4 are formed on the internal surface of the substrate 1. The electrodes 3 and 4 are formed by wholly providing a transparent conductive layer such as ITO or tin oxide on the internal surface of the substrate 1 by a thin film technique such as sputtering and carrying out pattern etching through photolithography, for example, to have a predetermined pattern.

Next, the bus electrodes 3*b* and 4*b* are formed. The bus electrodes 3*b* and 4*b* are formed by, first of all, wholly depositing a metal having a high conductive property such as Ag, Al, Ni, Cu or Cr through sputtering or the like over the discharge maintaining electrode groups 3 and 4 on the internal surface of the first substrate, and then performing the pattern etching through the photolithography or screen printing, for example, to have a predetermined pattern.

Thereafter, the dielectric layer 6 made of $SiO_2$, for example, is wholly formed by a CVD (Chemical Vapor Deposition) method or the like, and MgO having a small work function or a transparency to visible light is provided thereon in a thickness of approximately 0.5 μm to 1.0 μm, for example, by an electron beam deposition method and the surface layer 7 is thus formed.

On the other hand, a method of manufacturing the second substrate 2 side having the address electrode 8 will be first described for the case in which the partition wall 9 is formed by a printing method.

In this case, the address electrode 8 is formed on the second substrate 2 made of a glass substrate, for example. The address electrode 8 is formed by providing a metal such as Ag, Al, Ni, Cu or Cr having a high conductive property or an alloy having one of them or more in one layer or more through the sputtering or the like, and then performing the pattern etching through the photolithography or the screen printing, for example, to have a predetermined pattern.

Next, the partition wall 11 having a height of approximately 100 μms or more, for example, approximately 150 μms is formed between the address electrodes 8 and on the outside of the arrangement portion. The partition wall 11 is formed by repeating the printing and drying operation of a glass paste plural times, for example. Alternatively, a glass paste is wholly coated and a mask of a photoresist layer is formed thereon through the photolithography to have a predetermined pattern, for example. Then, sand blasting is carried out to remove the glass paste in a portion which is not covered with the mask. Thus, the predetermined pattern is obtained.

Then, phosphor layers R, G and B having respective colors are formed on the side surface of the partition wall 11 and the bottom face of a groove portion between the adjacent partition walls 11 in a predetermined order array along the groove, that is, in the extending direction of the partition wall 11 as shown in FIGS. 1 and 2 for each groove through the screen printing or coating, exposing and printing out using a photosensitive slurry.

Thereafter, the first and second substrates 1 and 2 are opposed in such a manner that the extending directions of the discharge maintaining electrodes 3 and 4 cross, for example, are orthogonal to the extending directions of the address electrode and the partition wall 11, and the surroundings of the first and second substrates 1 and 2 are subjected to frit seal so that a flat vessel is constituted by both substrates 1 and 2.

In the first and second substrates 1 and 2, thus, a space between both substrates 1 and 2 defined by the height of the partition wall 11, that is, a space between the address electrode 8 and the discharge maintaining electrodes 3 and 4 is defined.

By the first and second substrates 1 and 2, the flat vessel is exhausted and is filled with the above-mentioned discharge gas, for example, one or more of rare gases such as He, Ne, Ar, Xe and Kr, for example, a so-called Penning gas to be an optimum mixed gas of Ne and Xe at a predetermined pressure.

In this case, actually, at least one side edge of each of the first and second substrates 1 and 2 is formed to project from the other substrate toward the outside. In the projection portion, the end of each of the bus electrodes 3*b* and 4*b* and that of the address electrode 10 are extended and led to the outside of an airtight space and can be power supply terminals to the discharge maintaining electrodes 3 and 4 and the address electrode 10, respectively.

Thus, the flat display device according to the present invention can be constituted.

While the light emission display is observed on the first substrate 1 side in the above-mentioned example, it can also be observed on the second substrate 2 side. In this case, the address electrode 8 is constituted by a transparent conductive layer and the discharge maintaining electrodes 3 and 4 are constituted by Ag, Al, Cu, Ni or Cr, or one or more layers thereof.

Moreover, it is apparent that the flat display device and the manufacturing method thereof according to the present invention are not restricted to the above-mentioned example and can variously be changed and modified in the present invention.

As described above, in the flat display apparatus according to the present invention, the discharge maintenance is carried out through the cathode glow discharge. Consequently, the driving power can be more reduced than the case of the negative glow discharge.

Thus, a reduction in the driving power causes heat generation to be decreased. Therefore, it is possible to avoid the use of a heat radiating fan, to reduce the number of the heat radiating fans or power or to reduce the number of the heat radiating fans, the area or the like. Consequently, it is possible to reduce the size and weight of the whole device and the like in large area display.

Alternatively, when the driving power is to be set equal to or almost equal to that in the conventional example, it is possible to enhance a light emitting luminance. For example, when the driving power is to be equal to that in the conventional example, a brightness can be increased by 40% or more.

The discharge start to be carried out between the address electrode 8 and the discharge maintaining electrode 3 is performed through the negative glow discharge. Therefore, the space between the address electrode 8 and the discharge maintaining electrode 3 is selected to be great, for example, 150 ms. Consequently, the space in a portion where the phosphors R, G and B are arranged, and therefore, the area of arrangement of the phosphors R, G and B can fully be increased. Thus, bright display can be obtained.

As described above, moreover, the space between the discharge maintaining electrodes 3 and 4 can be reduced to ¼ or less as compared with the conventional example. Therefore, an arrangement pitch p of each pair of discharge maintaining electrodes can be more reduced than a conventional pitch P. Consequently, the density and definition of the pixel can be enhanced.

Furthermore, the shape of the gap g between the pair of discharge maintaining electrodes 3 and 4 is set to have a curved or bent pattern. Consequently, the length can be increased so that the amount of generated vacuum ultraviolet rays can be made larger. Thus, the luminance can be more enhanced.

What is claimed is:

1. A flat display apparatus, comprising:

first and second substrates positioned opposite to each other, said first substrate is provided with a discharge maintaining electrode group having a plurality of pairs of discharge maintaining electrodes arranged thereon with each pair of discharge maintaining electrodes having facially-opposing edges, and said second substrate is provided with an address electrode group having a plurality of address electrodes arranged thereon, wherein the facially-opposing edges of each pair of discharge maintaining electrodes are spaced apart sufficiently such that, upon energizing the flat panel apparatus, cathode glow discharge is mainly generated and negative glow discharge is hardly generated and respective address electrodes are sufficiently spaced apart from respective ones of the pairs of discharge maintaining electrodes which oppose the address electrodes such that negative glow discharge is generated.

2. The flat display apparatus according to claim 1, wherein a space between said edges of said discharge maintaining electrodes which makes a pair for the discharge maintaining of said discharge maintaining electrode group is selected to be less than 50 m, and a space between said address electrode and said discharge maintaining electrode is selected to be 100 m or more.

3. The flat display apparatus according to claim 1, wherein a space between said edges of the discharge maintaining electrodes which makes a pair for the discharge maintaining of said discharge maintaining electrode group is selected to be 20 m or less, and a space between said address electrode and said discharge maintaining electrode is selected to be 100 m or more.

4. The flat display apparatus according to claim 1, wherein a shape of a gap between mutual opposed edges of said pair of discharge maintaining electrodes has a pattern bent or curved in a width direction of said discharge maintaining electrode.

5. The flat display apparatus according to claim 1, wherein said discharge maintaining electrode and said address electrode which are arranged on said first and second substrates respectively are constituted by a conductive material layer and said discharge maintaining electrode is coated with a dielectric layer.

6. The flat display apparatus according to claim 5, wherein the conductive material layer constituting said discharge maintaining electrode and said address electrode is formed of a transparent conductive material, Ag, Al, Cu, Ni, Cr or an alloy thereof or a lamination.

7. The flat display apparatus according to claim 1, wherein a partition wall is formed between said address electrodes of the second substrate and phosphors having respective colors are formed in a predetermined order array between said partition walls, thereby carrying out color display.

8. The flat display apparatus according to claim 1, wherein a flat space formed between the first and second substrates is filled with a Penning gas.

* * * * *

UNITED STATES PATENT AND TRADEMARK OFFICE

CERTIFICATE OF CORRECTION

PATENT NO. : 6,541,913 B1
DATED : April 1, 2003
INVENTOR(S) : Hiroshi Mori et al.

It is certified that error appears in the above-identified patent and that said Letters Patent is hereby corrected as shown below:

Column 8,
Line 56, replace “50 m” with -- 50 μm --.
Lines 58 and 65, replace “100 m” with -- 100 μm --.
Line 63, replace “20 m” with -- 20 μm --.

Signed and Sealed this

Ninth Day of December, 2003

JAMES E. ROGAN
*Director of the United States Patent and Trademark Office*